US006518930B2

(12) United States Patent
Itoh et al.

(10) Patent No.: US 6,518,930 B2
(45) Date of Patent: Feb. 11, 2003

(54) LOW-PROFILE CAVITY-BACKED SLOT ANTENNA USING A UNIPLANAR COMPACT PHOTONIC BAND-GAP SUBSTRATE

(75) Inventors: Tatsuo Itoh, Los Angeles, CA (US); Yongxi Qian, Los Angeles, CA (US); Fei-Ran Yang, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/872,201

(22) Filed: Jun. 1, 2001

(65) Prior Publication Data

US 2001/0050641 A1 Dec. 13, 2001

Related U.S. Application Data

(60) Provisional application No. 60/209,156, filed on Jun. 2, 2000.

(51) Int. Cl.[7] ..... H01Q 13/00

(52) U.S. Cl. ..... 343/767; 343/700 MS

(58) Field of Search ..... 343/700 MS, 767, 343/770, 705

(56) References Cited

U.S. PATENT DOCUMENTS

| | | | | | |
|---|---|---|---|---|---|
| 5,386,215 | A | * | 1/1995 | Brown | 343/792.5 |
| 5,541,614 | A | * | 7/1996 | Lam et al. | 343/701 |
| 6,175,337 | B1 | * | 1/2001 | Jasper et al. | 343/770 |
| 6,177,909 | B1 | * | 1/2001 | Reid et al. | 343/700 MS |
| 6,307,519 | B1 | * | 10/2001 | Livingston et al. | 343/746 |

OTHER PUBLICATIONS

Y. Yoshimura, "A microstripline slot antenna," IEEE Trans. Microwave Theory Tech., MTT–20, pp. 760–762. Nov. 1972.

Y. Qian, D. Sievenpiper, V. Radisic, E. Yablonovitch, and T. Itoh, "A novel approach for gain and bandwidth enhancement of patch antennas," in IEEE RAWCON Proceedings, 1998, pp. 221–224.

D. Sievenpiper, R. Broas, and E. Yablonovitch, "Antennas on high–impedance ground planes," IEEE MTT–S Digest, 1999, pp. 1245–1248.

K. Ma, K. Hirose, F. Yang, Y. Qian and T. Itoh, "Realization of magnetic conducting surface using novel photonic band-gap structure," Electronics Lett., vol. 34, No. 21, pp. 2041–2042, Oct. 15, 1998.

F. Yang, K. Ma, Y. Qian and T. Itoh, "A Novel TEM-Waveguide Using Uniplanar Compact Photonic Band–Gap (UC–PBG) Structure," IEEE Trans. Microwave Theory Tech., vol. 47, pp. 2092–2098 [323–326], Nov. 1999.

(List continued on next page.)

*Primary Examiner*—Tan Ho

(74) *Attorney, Agent, or Firm*—Gates & Cooper LLP

(57) ABSTRACT

A low-profile cavity-backed slot antenna is disclosed including a cavity substrate having a slot with a resonant frequency and a uniplanar compact photonic band-gap (UC-PBG) substrate, proximate to the cavity substrate and having a two-dimensional periodic metallic pattern on a dielectric slab and a ground plane, wherein the UC-PBG substrate behaves substantially as an open boundary at the resonant frequency of the slot. The slot antenna has reduced height while maintaining good performance.

24 Claims, 7 Drawing Sheets

OTHER PUBLICATIONS

Coccioli, Roberto et al., "Aperture–Coupled Patch Antenna on UC–PBG Substrate", IEEE Transactions on Microwave Theory and Techniques, vol. 47, No. 11, Nov. 1999, pp. 2123–2130, XP–000865110.

Hashemi–Yeganeh, Shahrokh et al., "Theoretical and Experimental Studies of Cavity–Backed Slot Antenna Excited by a Narrow Strip," IEEE Transactions on Antennas and Propagation, vol. 41, No. 2, Feb. 1993, New York, US, pp. 236–241, XP–000303633.

Moyer, H.P. et al., "Active Cavity–Backed Slot Antenna Using MESFET's", IEEE Microwave and Guided Wave Letters, vol. 3, No. 4, Apr. 1993, New York, US, pp. 95–97, XP–000358562.

Shumpert, John D. et al., "Parallel–Plate Mode Reduction in Conductor–Backed Slots Using Electromagnetic Bandgap Substrates," IEEE Transactions on Microwave Theory and Techniques, vol. 47, No. 11, Nov. 1999, pp. 2099–2103, XP–000865107.

* cited by examiner

LOW-PROFILE CAVITY-BACKED SLOT ANTENNA USING A UNIPLANAR COMPACT PHOTONIC BAND-GAP SUBSTRATE

CROSS-REFERENCE TO RELATED APPLICATIONS

This application claims the benefit under 35 U.S.C. §119 (*e*) of co-pending and commonly assigned U.S. Provisional Patent Application Serial No. 60/209,156, filed on Jun. 2, 2000, by Tatsuo Itoh, Yongxi Qian, and Fei-Ran Yang, entitled "LOW-PROFILE CAVITY-BACKED SLOT ANTENNA USING A UC-PBG SUBSTRATE," which application is incorporated by reference herein.

STATEMENT REGARDING FEDERALLY-SPONSORED RESEARCH OR DEVELOPMENT

This invention was made with Government support under Grant No. DAAH04-961-0005, awarded by the Army. The Government has certain rights in this invention.

BACKGROUND OF THE INVENTION

1. Field of the Invention

The present invention relates to cavity-backed slot antennas, and particularly to low-profile cavity-backed slot antennas using a uniplanar compact photonic band-gap substrate.

2. Description of the Related Art

Cavity-backed slot (CBS) antennas have been extensively investigated for applications to airborne and satellite communications, because they satisfy the requirements of flush mounting, low cost and light weight. The cavity height is usually designed to be one-quarter wavelength or three-quarters of a wavelength at the resonator frequency in order not to destroy impedance matching, since the backing conductor is transformed to an open circuit in shunt with the slot. The cavity volume can be reduced through dielectric loading, but the bandwidth and efficiency will also be reduced.

Applications of photonic band-gap (PBG) materials to antennas have been presented for leakage modes suppression. Recently proposed uniplanar compact PBG (UC-PBG) structures exhibit a distinctive stopband and have been exploited to reduce surface wave of patch antennas.

There is a need in the art for low-profile flush-mounting antennas for airborne and satellite applications. There is further a need in the art for cavity-backed slot antennas with reduced cavity volumes, and particularly with low profile cavities, but without a loss of efficiency. There is further a need in the art for such low-profile cavity-backed slot antennas but without diminished bandwidth. The present invention meet these needs.

SUMMARY OF THE INVENTION

To minimize the limitations in the related art described above, and to minimize other limitations that will become apparent upon reading and understanding the present specification, the present invention discloses a low-profile cavity-backed slot antenna including a cavity substrate having a slot with a resonant frequency and a uniplanar compact photonic band-gap (UC-PBG) substrate proximate to the cavity substrate and having a two-dimensional periodic metallic pattern on a dielectric slab and a ground plane, wherein the UC-PBG substrate behaves substantially as an open boundary at the resonant frequency of the slot, The substrate allows for a reduced cavity size while maintainnig efficient antenna performance.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Cavity-Backed Slot (CBS) Antenna

Figure 1A:
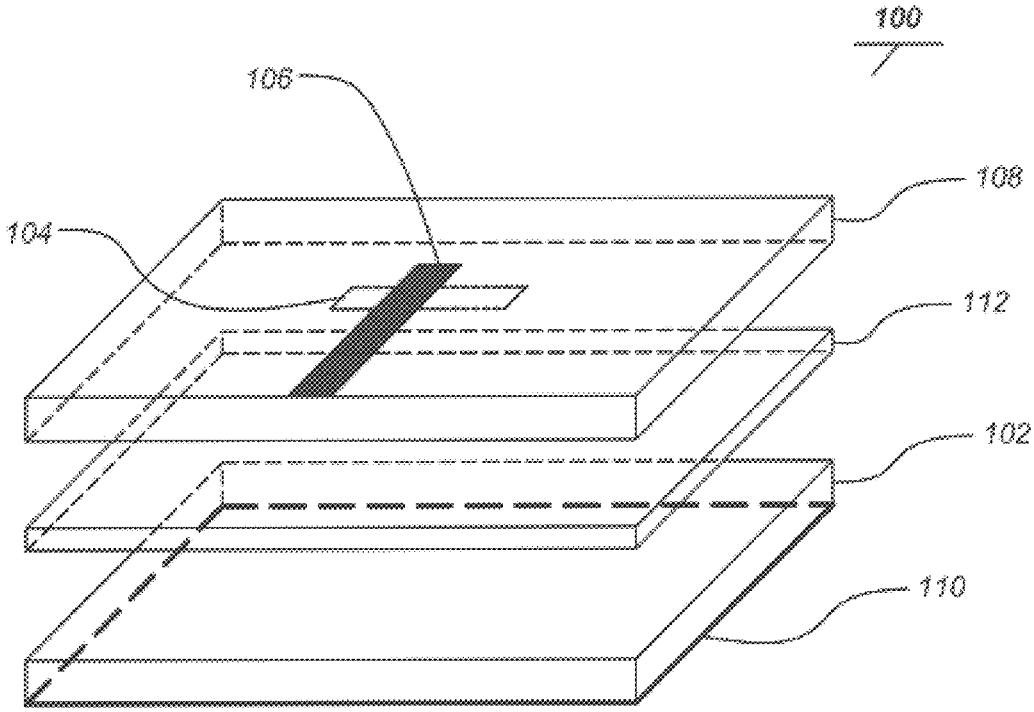
FIGS. 1A and 1B illustrate respectively an exploded schematic and cross section of a typical CBS antenna of the present invention using the UC-PBG substrate as a high-impedance reflector.
Figure 1B:
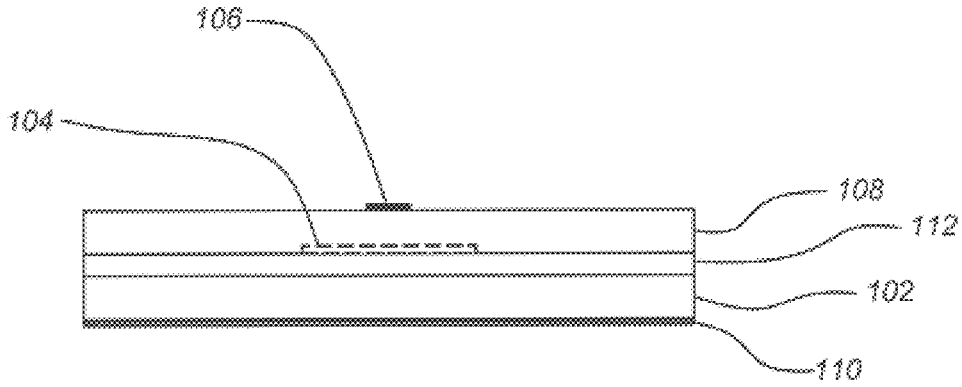

FIGS. 1A and 1B illustrate, respectively, an exploded schematic and a cross section of a typical CBS antenna 100 of the present invention using a UC-PBG substrate 102 as a high-impedance reflector. A slot 104 is center-fed by an open-ended microstrip 106 at the top layer of a cavity substrate 108, which is different from usual CBS antennas with slots at outer surfaces of cavities.

The present invention demonstrates a new type of CBS antenna 100 with a very thin cavity thickness, defined by the UC-PBG substrate 102 and any spacing layer (or the height of the slot 104 from the ground plane 110), such as the dielectric sheet 112. The UC-PBG substrate 102 is a dielectric substrate, grounded by the ground plane 110, loaded with a periodic metallic pattern (not shown), and serves as a reflector in the slot 104. Tis thin substrate 102 behaves like an open circuit boundary at a resonant frequency, and therefore good impedance matching condition of the mictostrip-fed slot 104 is maintained. The thickness of the low-profile cavity, height of the slot 104 from the ground plane 110 is 35 mil ($\lambda_0/28$), which is much smaller than that of a reference antenna using an empty metal cavity with a thickness of 246 mil ($\lambda_0/4$). An example antenna 100 is designed to operate at 12 GHz and the measured radiation patterns shows a front-to-back ratio of 15 dB, as well as low cross polarization levels.

The structure described is used to avoid perturbation of the microstrip 106 mode by the slot 104. The UC-PBG substrate 102 is maintained proximate to the cavity substrate 108. A dielectric sheet 112 is inserted between the slot 104 and the UC-PBG substrate 102, i.e., the high-impedance reflector, as a spacing layer. The slot 104 length and the distance between the microstrip 106 open end and the slot 104 center was initially designed as half- and quarter-wavelength, respectively, for the stand-alone slot antenna (comprising only the cavity substrate 108 with the slot 104 and the feeding microstrip 106) without considering the presence of the UC-PBG substrate 102. Optimizations of the slot 104 dimensions and the feeding microstrip 106 have been achieved using FDTD to simulate the entire structure. This FDTD analysis was then applied to simulate the CBS antenna 100 loaded with the UC-PBG substrate 102, wherein the dimensions of the slot 104 and the feeding mnicrostrip 106 are adjusted as necessary to match the resonant frequency of the stand-alone slot antenna to that of the UC-PBG substrate 102.

Figure 2:
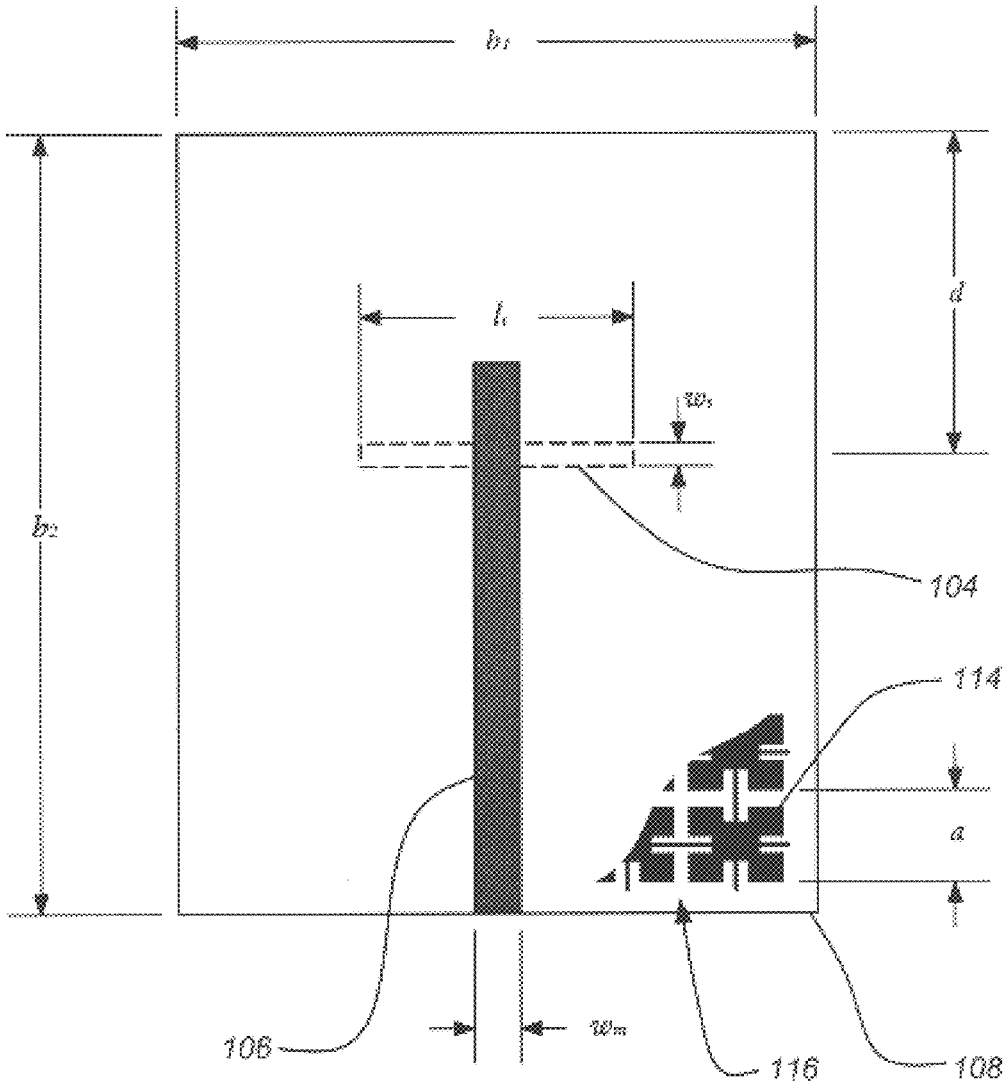
FIG. 2 illustrates detailed dimensions of the slot and microstrip for an example cavity-backed slot antenna of the present invention.

FIGS. 2 and 3 illustrate detailed dimensions of an example CBS antenna 100 of the present invention. FIG. 2 illustrates detailed dimensions of the slot 104 and microstrip 106 for the example CBS antenna 100 of the present invention. The rnicrostrip 106 on the top surface of the cavity substrate 108 has a width, $w_m$, and the slot 104 length and width are $l_s$ and $w_s$, respectively. The cavity substrate 108 has overall dimensions of $b_1$ and $b_2$ and the slot 104 is offset from an edge of the cavity substrate 108 by a dimension, d. Beneath the cavity substrate 108, a cell 114 of the pattern 116 on the UC-PBG substrate 102 has a dimension, a.

Figure 3B:
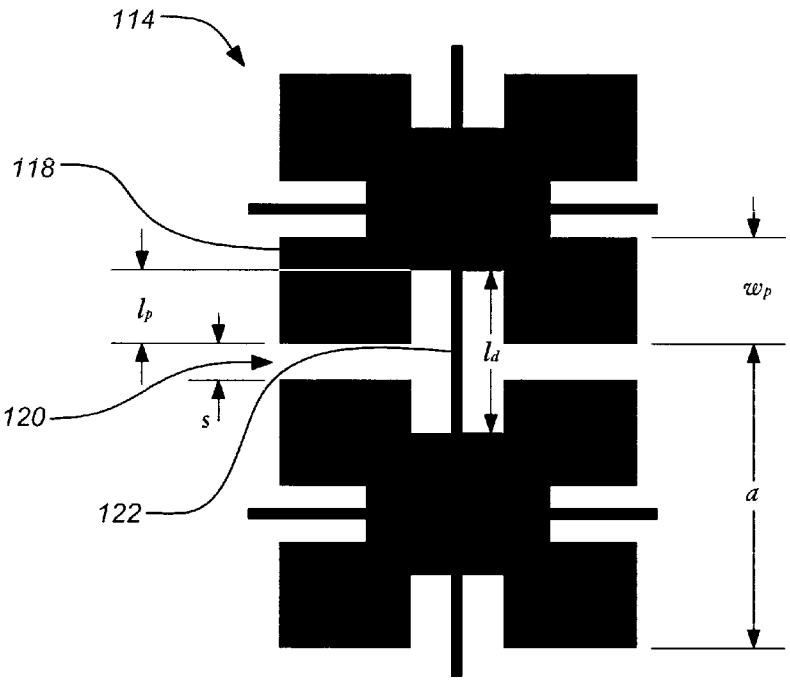
FIGS. 3A and 3B illustrate respectively details of the UC-PBG substrate and detailed dimensions of the cell pattern for the example cavity-backed slot antenna of the present invention.
Figure 3A:
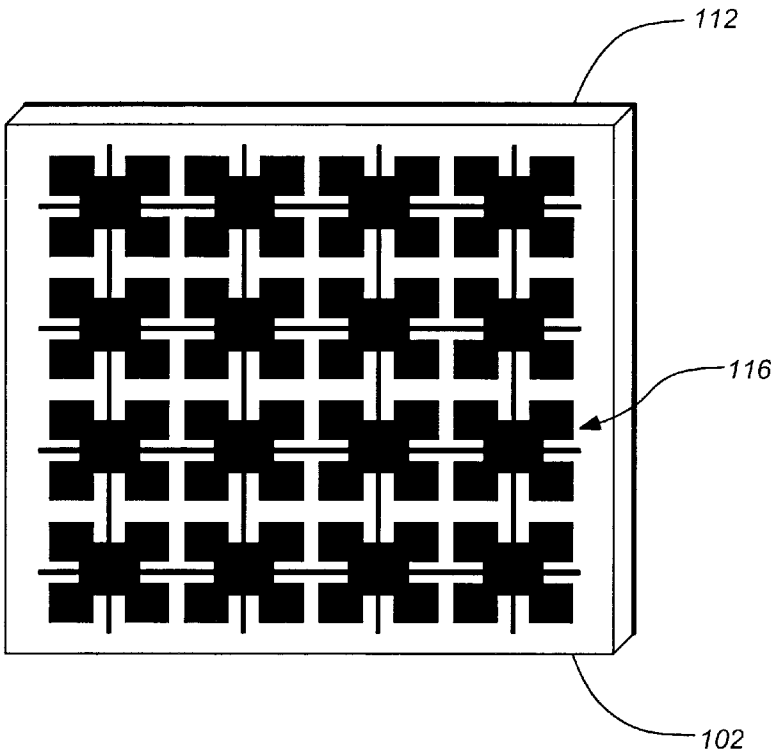

FIGS. 3A and 3B illustrate respectively details of the UC-PBG substrate 102 and detailed dimensions of the cell pattern 116 for the example CBS antenna 100 of the present invention. The UC-PBG substrate 102 includes a two-dimensional metallic pattern 116 periodically etched on the surface of a grounded dielectric slab. Previous works show that there exists a complete stopband from 11 GHz to 14 GHz, meaning that no surface-wave or slab mode can be excited in that frequency range. The detail dimensions of the UC-PBG substrate 102 can be found in the publications: K. Ma, K. Hirose, F. Yang, Y. Qian and T. Itoh, "Realization of magnetic conducting surface using novel photonic bandgap structure," Electronics Lett., vol. 34, pp. 2041–2042, and in F. Yang, K. Ma, Y. Qian and T. Itoh, "A Novel TEM-Waveguide Using Uniplanar Compact Photonic Band-Gap (UC-PBG) Structure," IEEE Trans. Microwave Theory Tech., vol. 47, pp. 2092–2098, Nov. 1999, all of which are incorporated by reference herein. The present invention utilizes another unique property of the UC-PBG substrate 102 (beyond the distinctive stopband), which is the realization of an equivalent open-circuit boundary at the resonant frequency.

In the present invention, the necessity of using a quarter-wavelength thick cavity is avoided by applying the periodic metallic pattern 116 loaded on a dielectric substrate 102 with a ground plane 108. Each cell 114 of this periodic pattern 116 provides inductances in shunt with capacitances. The combination of periodic loading and a shorted slab forms an LC tank, which behaves as an open circuit at a resonant frequency. The reflection coefficient of a uniform plane wave normally incident on the UC-PBG substrate 102 was simulated using finite-difference time-domain (FDTD) and the result showed a 180° phase difference compared to the reflection from a perfect electric conductor (AEC) at 13 GHz, indicating that an open circuit boundary was realized at the UC-PBG substrate 102 surface. This property has been verified by experiments and applied to build a transverse electromagnetic (TEM) waveguide in the reference above. The periodic metallic pattern 116 of cells 114 is a unique two-dimensional periodic structure that comprises square pads 118 separated by capacitive gaps 120, and inductive lines 122 connecting adjacent cells 114. The dimensions, a, $w_p$, $w_d$, s, $l_p$and $l_d$ define the example pattern 116 as shown in FIG. 3. The square pads have a side dimension, a, and the capacitive gaps have a dimension, s, and the inductive lines have a length, $l_d$.

By loading the UC-PBG pattern 116, the transformation from shorting plate to an open circuit at the air-dielectric interface is accomplished even for a thin slab. A low-profile CBS antenna 100 can be built using this thin UC-PBG substrate 102 as a backing substrate serving as a reflector without degrading the matching condition. A finite-difference time-domain (FDTD) method is used to design and analyze the proposed CBS antenna 100, which is then fabricated and measured to verify its usefulness.

Based on the full-wave simulation results, an example cavity-backed slot antenna 100 using the high-impedance reflector was manufactured with the following dimensions (units in mils): $b_1$=2000, $b_2$=2100, $l_s$=400, $w_s$=20, $w_m$=90, d=700, a=120, $w_p$=40, $w_d$=s=10, $l_p$=27.5 and $l_d$=65. The slot 104 and the 90 mil wide microstrip 106 feedline were built on an RT/Duroid 5870™ cavty substrate 108 with dielectric constant of 2.33 and thickness of 31 mil. The spacing layer is a bare dielectric sheet 112 with dielectric constant of 2.33 and thickness of 10 mil. The UC-PBG substrate 102, used as the high impedance reflector, was fabricated on an RT/Duroid 6010 ™ substrate with dielectric constant of 10.2 and thickness of 25 mil. The different layers of substrates were bonded together using dielectric paste with $\in_r$=2.16 and tan $\delta$=0.001. Copper tape was then used to enclose the side walls of dielectric layers.

Simulated and Experimental Results

Simulations and measurements have been conducted to obtain the reflection coefficient of the plane wave incident on the periodically loaded substrate. At certain frequencies, the reflection coefficient shows a 180 degree phase difference compared to that of the plane wave incident on a metal sheet, indicating that an open-circuit boundary has been realized. This phenomenon can be expected since the periodic metallic pattern 116 together with the grounded substrate 102 form a distributed LC circuit and the input impedance is infinite at the resonant frequency. Full-wave analysis also shows that there exists a complete stopband centering around the resonant frequency, where surface waves and slab modes cannot propagate. The periodically loaded substrate 102 can be used as a high-impedance reflector in a CBS antenna 100 to provide uni-directional radiation patterns and to maintain good impedance matching at the same time.

Figure 4:
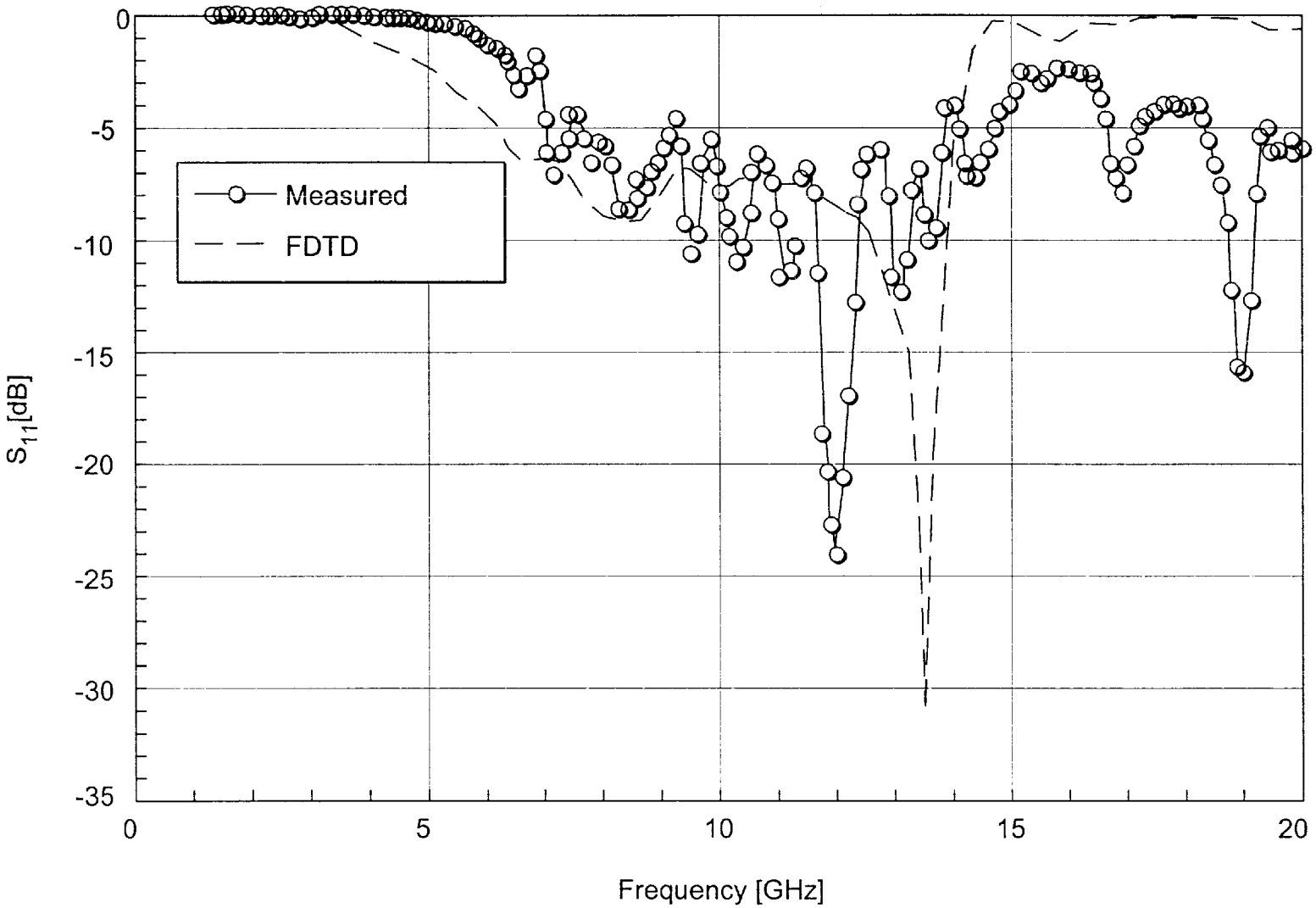
FIG. 4 is a plot of the insertion loss ($S_{11}$) of the example CBS antenna.

FIG. 4 is a plot of the insertion loss ($S_{11}$) of the example CBS antenna 100. The insertion loss was measured using an HP 8720A ™ network analyzer and the result is shown in FIG. 4 together with the simulated $S_{11}$ from the FDTD. The measured resonant frequency is 12.05 GHz and the 10 dB bandwidth is 5.8%. The trend of experimental data agrees well with simulation, except for the full-wave analysis predicting a higher resonant frequency since the effects of over-etching and dielectric paste were not taken into account.

Figure 5A:
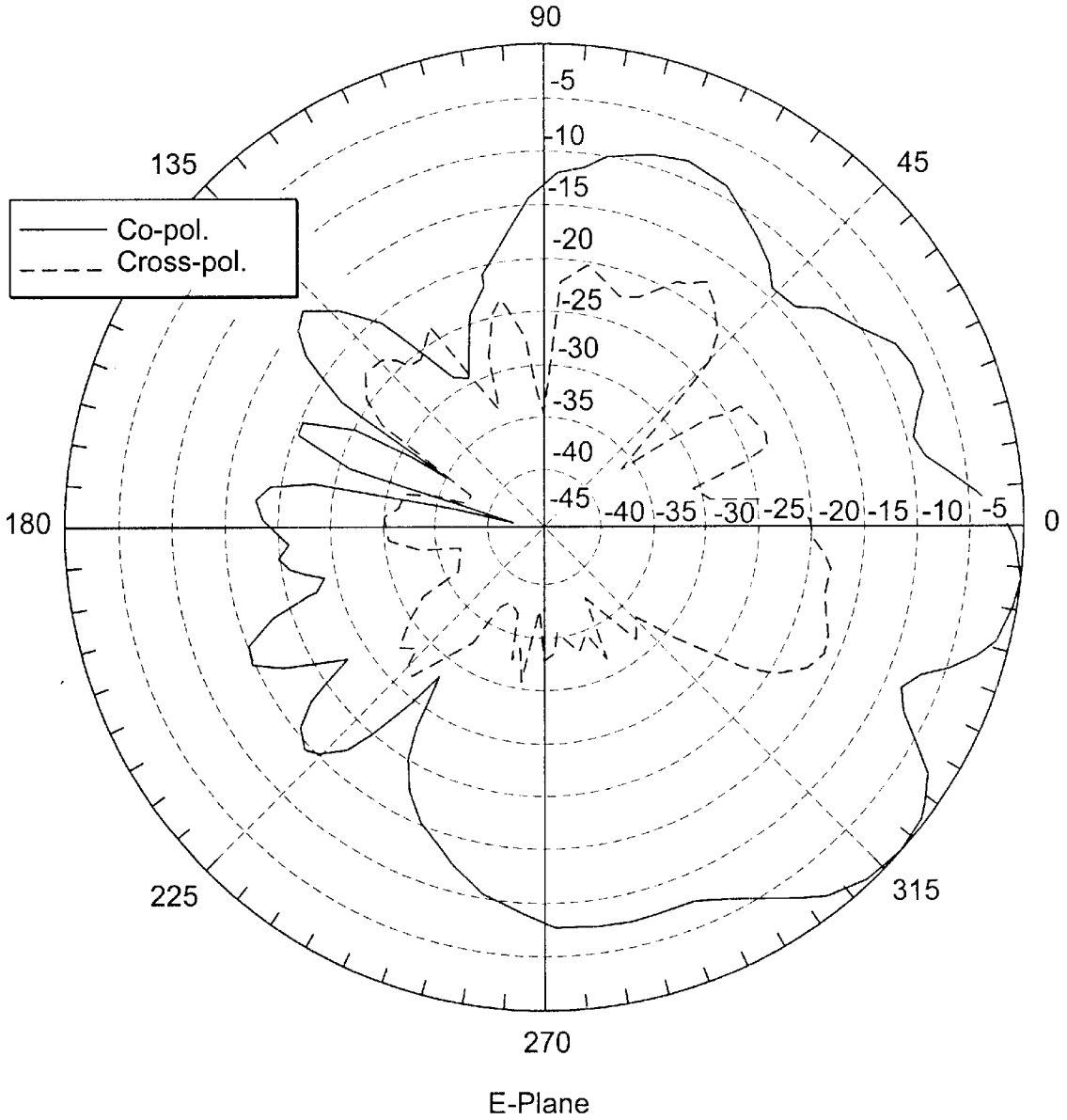
FIGS. 5A and 5B show respectively the measured normalized E-plane and H-plane radiation patterns for the example CBS antenna at 12.05 GHz.
Figure 5B:
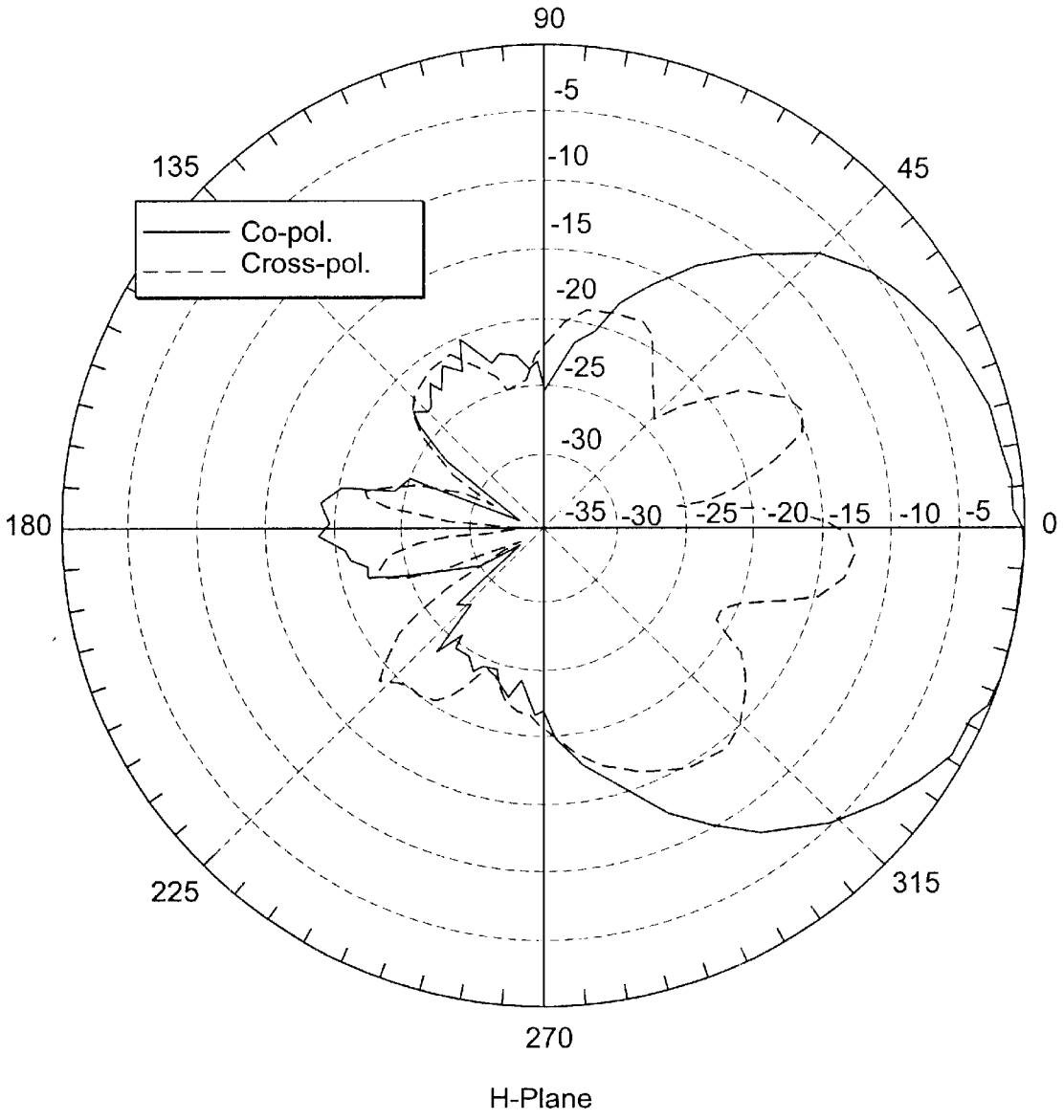

FIGS. 5A and 5B show, respectively, the measured normalized E-plane and H-plane radiation patterns for the example CBS antenna 100 at 12.05 GHz. The front-to-back ratio is 15 dB for the E-plane and 18 dB for the H-plane patterns. The cross-polarization level is 12 dB to 15 dB below the co-polarization level for both planes. The pattern distortion observed in the E-plane comes from the existence of the microstrip 106 feed line and this problem can be alleviated using other feeding structures such as a coaxial line. The tmeasured gain of this novel CBS antenna 100 is approximately 2.5 dB.

Figure 6:
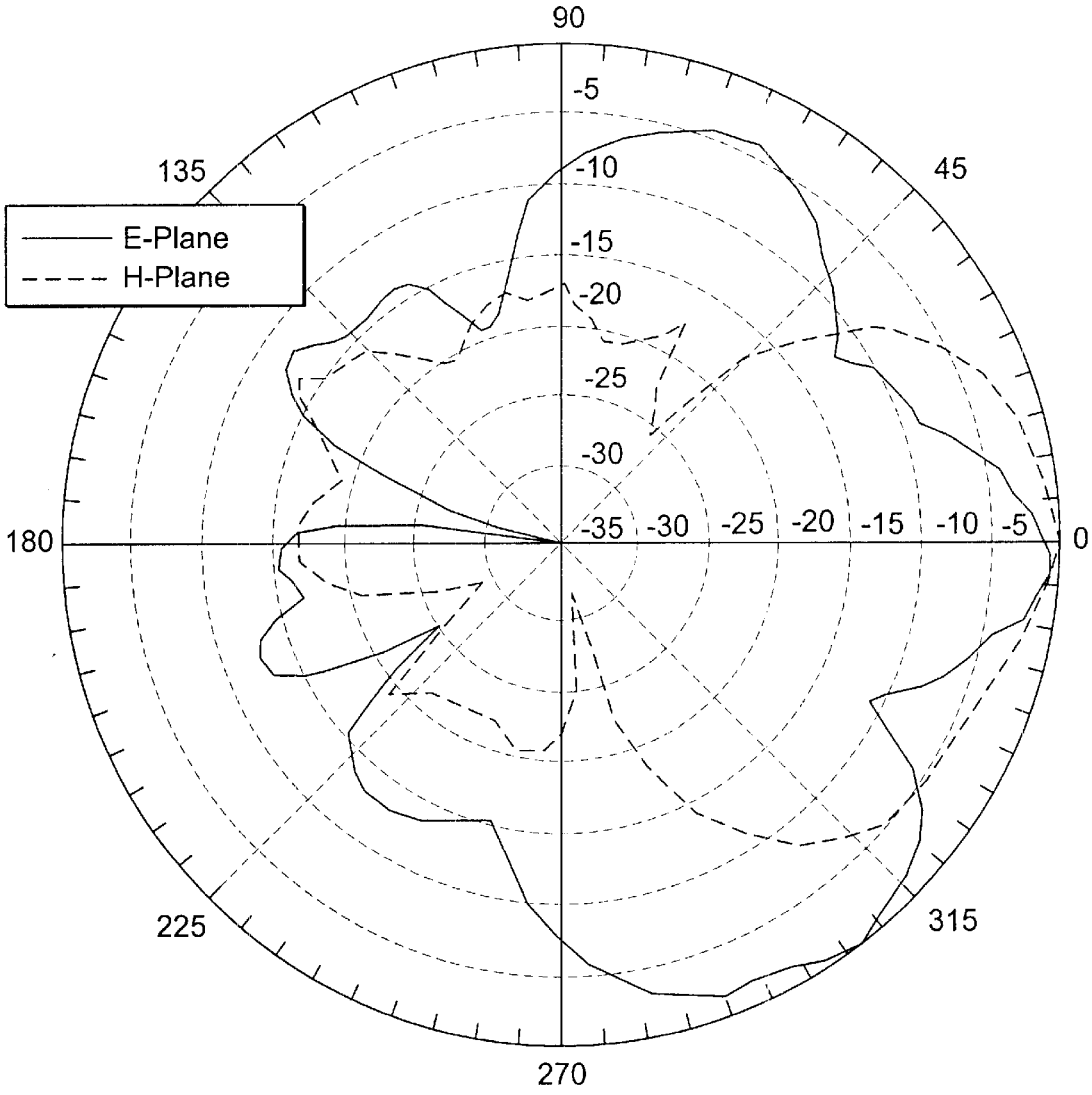
FIG. 6 illustrates the radiation patterns of a reference CBS antenna.

FIG. 6 illustrates the radiation patterns of a reference CBS antenna. The reference CBS antenna has been built using an empty metal cavity with the height equal to a quarter free-space wavelength (246 mil). The comparison between the CBS antenna 100 of the present invention and the reference CBS antenna reveals that the CBS antenna 100 using the UC-PBG substrate 102 as a high-impedance reflector not only achieves the low-profile design but also provides good radiation patterns.

The problem of surface wave or slab mode excitation on the high-impedance reflector CBS antenna 100 of the present invention does not exist since the periodic structure 116 of the UC-PBG substrate 102 creates a complete stop-band at the resonant frequency. The fabrication process requires only planar etching technique, which is very cost-effective. The dimensions of the high-impedance reflector 102 can be scaled to any other frequencies in order to match antenna resonant frequencies. The bandwidth of the CBS antenna 100 itself can be increased by optimizing the slot 104 width. Meanwhile, the bandwidth of the high-impedance reflector 102 can be enlarged by inserting more layers of periodic loading.

Conclusions

A low-profile CBS antenna 100 has been realized using the UC-PBG substrate 102 as a reflector, which behaves like an open-circuit boundary at a resonant frequency. The slot 104 height from the ground plane 110 is much smaller $\lambda_0/28$ (35 mil) compared to a conventional slot antenna back ed by a metallic cavity with thickness of $\lambda_0/4$ (246 mil). Front-to-back ratio of 15 dB and low cross-polarization level have been measured. Measured results of the novel CBS antenna 100 do not show degradation in the radiation performances compared to the reference antenna. The proposed CBS antenna 100 is very easy to fabricate due to its planar feature and can be readily applied to CBS arrays, which are often used for satellite communications. This concept of using a UC-PBG substrate 102 as a backing cavity or reflecting plane can be extended to find more applications, such as CBS arrays, phased-array systems, and loop antennas.

In addition, many equivalent structures affording low profile avities by using UC-PBG substrates 102 which produce an open circuit boundary at a resonant frequency will be apparent to those skilled in the art. Particularly, various equivalent patterns 116 of cells 114 on the UC-PBG substrate 102 may also be described for arrange of resonant frequencies yielding substantially similar results.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the apparatus and method of the invention. Since many embodiments of the invention can be made without departing from the spirit and scope of the invention, the invention resides in the claims hereinafter appended.

REFERENCES

The following references are incorporated by reference herein:

1. S. Hashemi-Yeganeh and C. Birtcher, "Theoretical and experimental studies of cavity-backed slot antenna excited by a narrow strip," IEEE Trans. Antennas Propagat., vol. 41, pp. 236–241, February 1993.
2. Y. Yoshimuta, "A microstripline slot antenna," IEEE Trans. Microwave Theory Tech., MTT-20, pp. 760–762. November 1972.
3. Y. Qian, D. Sievenpiper, V. Radisic, E. Yablonovitch, and T. Itoh, "A novel approach for gain and bandwidth enhancement of patch antennas," in IEEE RAWCON Symp. Dig., Colorado Springs, Colo., August 9–12, 1998, pp. 221–224.
4. D. Sievenpiper, R. Broas, and E. Yablonovitch, "Antennas on high-impedance ground plane," IEEE MTT-S Symp. Dig., Anaheim, Calif., Jun. 13–19, 1999, pp. 1245–1248.
5. J. Shumpert, W. Chappell, and L. Katehi, "Parallel-plate mode reduction in conductor-backed slots using electromagnetic bandgap substrates," IEEE Trans. Microwave Theory Tech., vol. 47, pp. 2099–2104. November 1999.
6. R. Coccioli, F. R. Yang, K. P. Ma, and T. Itoh, "Aperture coupled patch antenna on UC-PBG substrate," IEEE Trans. Microwave Theory Tech, vol. 47, pp. 2123–2130. November 1999.
7. K. Ma, K. Hirose, F. Yang, Y. Qian and T. Itoh, "Realization of magnetic conducting surface using novel photonic bandgap structure," Electronics Lett., vol. 34, pp. 2041–2042.
8. F. Yang, K. Ma, Y. Qian and T. Itoh, "A Novel TEM-Waveguide Using Uniplanar Compact Photonic Band-Gap (UC-PBG) Structure," IEEE Trans. Microwave Theory Tech., vol. 47, pp. 2092–2098, November 1999.
9. J. Klaus, Antennas, 2nd Ed, McGraw-Hill, 1988.

What is claimed is:

1. A cavity-backed slot antenna, comprising:

a cavity substrate including a slot having a resonant frequency; and a uniplanar compact photonic band-gap (UC-PBG) substrate proximate to the cavity substrate and having a two-dimensional periodic metallic pattern on a dielectric slab and a ground plane;

wherein the UC-PBG substrate behaves substantially as an open boundary at the resonant frequency of the slot.

2. The cavity-backed slot antenna of claim 1, further comprising a dielectric sheet between cavity substrate and the UC-PBG substrate as a spacing layer.

3. The cavity-backed slot antenna of claim 2, wherein the dielectric sheet has a dielectric constant of approximately 2.33.

4. The cavity-backed slot antenna of claim 1, further comprising an open-ended mictostrip at a top surface of the cavity substrate, wherein the slot is center-fed by the microstrip.

5. The cavity-backed slot antenna of claim 1, wherein the pattern comprises repeating cells and each cell provides inductances in shunt with capacitances to produce the open boundary at the resonant frequency.

6. The cavity-backed slot antenna of claim 5, wherein the cells comprise square pads separated by capacitive gaps, and inductive lines connecting adjacent cells.

7. The cavity-backed slot antenna of claim 6, wherein the square pads have a side dimension, a, and the capacitive gaps have a dimension, s, and the inductive lines have a length, $l_d$.

8. The cavity-backed slot antenna of claim 1, wherein the slot is formed in the cavity substrate on a side proximate to the UC-PBG substrate.

9. The cavity-backed slot antenna of claim 1, wherein the cavity substrate has a dielectric constant of approximately 2.33.

10. The cavity-backed slot antenna of claim 1, wherein a height of the slot from the ground plane is approximately $\lambda_o/28$.

11. The cavity-backed slot antenna of claim 1, wherein the resonant frequency is approximately 12.05 GHz.

12. The cavity-backed slot antenna of claim 1, wherein the dielectric slab of the UC-PBG substrate has a dielectric constant of approximately 10.2.

13. A method of producing a cavity-backed slot antenna, comprising:

providing a cavity substrate including a slot having a resonant frequency; and providing a uniplanar compact photonic band-gap (UC-PBG) substrate proximate to the cavity substrate and having a two-dimensional periodic metallic pattern on a dielectric slab and a ground plane;

wherein the UC-PBG substrate behaves substantially as an open boundary at the resonant frequency of the slot.

14. The method of claim 13, further comprising providing a dielectric sheet between cavity substrate and the UC-PBG substrate as a spacing layer.

15. The method of claim 14, wherein the dielectric sheet has a dielectric constant of approximately 2.33.

16. The method of claim 13, further comprising feeding the slot with an open-ended microstrip at a top surface of the cavity substrate.

17. The method of claim 13, wherein the pattern comprises repeating cells and each cell provides inductances in shunt with capacitances to produce the open boundary at the resonant frequency.

18. The method of claim 17, wherein the cells comprise square pads separated by capacitive gaps, and inductive lines connecting adjacent cells.

19. The method of claim 18, wherein the square pads have a side dimension, a, and the capacitive gaps have a dimension, s, and the inductive lines have a length, $l_d$.

20. The method of claim 13, wherein the slot is formed in the cavity substrate on a side proximate to the UC-PBG substrate.

21. The method of claim 13, wherein the cavity substrate has a dielectric constant of approximately 2.33.

22. The method of claim 13, wherein a height of the slot from the ground plane is approximately $\lambda_o/28$.

23. The method of claim 13, wherein the resonant frequency is approximately 12.05 GHz.

24. The method of claim 13, wherein the dielectric slab of the UC-PBG substrate has a dielectric constant of approximately 10.2.

* * * * *